340-566 SR

8/4/81 OR 4,282,518

United States Patent [19]

Bonner

[11] 4,282,518

[45] Aug. 4, 1981

[54] VIBRATION RESPONSIVE DOOR ALARM

[76] Inventor: Edgar L. Bonner, Rte. 4, Box 101-B, Taylorsville, N.C. 28681

[21] Appl. No.: 56,132

[22] Filed: Jul. 9, 1979

[51] Int. Cl.[3] ..... G08B 13/08

[52] U.S. Cl. ..... 340/566; 340/527; 340/546

[58] Field of Search ..... 340/546, 566, 527, 545, 340/65, 309.1, 571; 307/293, 252 A, 252 R

[56] References Cited

U.S. PATENT DOCUMENTS

| | | | |
|---|---|---|---|
| 3,192,517 | 6/1965 | Werlin | 340/546 |
| 3,417,297 | 12/1968 | Wallentowitz | 307/293 |
| 3,721,956 | 3/1973 | Hamann et al. | 340/571 |
| 3,725,890 | 4/1973 | Cirino | 340/65 |
| 4,035,668 | 7/1977 | Minami et al. | 307/293 |
| 4,057,791 | 11/1977 | Bimmerle et al. | 340/566 |
| 4,103,294 | 7/1978 | Stettner et al. | 340/309.1 |
| 4,151,507 | 4/1979 | Willis | 340/65 |

*Primary Examiner*—Glen R. Swann, III

*Attorney, Agent, or Firm*—Blair, Brown & Kreten

[57] ABSTRACT

An alarm device responsive to vibration includes a unitary housing in which is disposed an SCR for connecting an alarm signal to an associated source of power, the gate of the SCR being connected to a pendulum and ring assembly with the pendulum being normally suspended within the ring out of engagement therewith but which moves into engagement with the ring when the housing is subjected to vibration to apply power to the SCR gate so that the SCR conducts to actuate the alarm signal for indicating the application of a vibration to the housing or a supporting structure on which the housing is mounted. The alarm device may also include timing circuitry which deactivates the SCR after a predetermined period of time.

3 Claims, 3 Drawing Figures

VIBRATION RESPONSIVE DOOR ALARM

BACKGROUND OF THE INVENTION

The emphasis on intrusion protection devices for residences, office buildings, etc. is widespread today with various alarm systems being proposed as well as such systems being readily available commercially. These intrusion protection devices may include sensors responsive to heat, sound, forced entry and the like which trigger various alarms connected thereto. It has been contemplated that a sensor which is responsive to vibration offers one convenient approach to intrusion protection since it is not uncommon for a intruder to forcibly break into a structure thereby moving a closure such as a window, door or the like. To provide such a sensor responsive to vibration created by forcible entry has met with certain design problems since the sensor must respond to forces of relatively small magnitude which are a common characteristic of an illegal entry. The necessary degree of sensitivity of such a sensor has been difficult to obtain and then only with quite complex electronic circuitry. Such complex electronic devices particularly when designed for use in residences or the like are necessarily high in cost contributing substantially to consumer resistance. Furthermore, present day sensors are usually tailored for a particular installation and therefore do not permit ready interchangability from one location to another in a protected structure.

OBJECTS AND SUMMARY OF THE INVENTION

Accordingly, a primary object of this invention is to provide a new and novel vibration responsive alarm device of extreme sensitivity.

Another object of this invention is to provide a new and novel alarm device which may be simply and easily attached to any supporting structure and which produces an alarm in response to the slightest movement of such a supporting structure.

A further object of this invention is to provide a new and novel alarm device which is simple and inexpensive in construction, which is composed of a minimum of commercially available component parts and which is capable of prolonged use without breakdown.

Still another object of this invention is to provide a new and novel vibration responsive alarm device which is completely self-contained and which may be mounted in an inconspicuous manner on any structure likely to be moved by an intruder and which quickly responds with an audible signal upon the slightest movement of the structure on which the unit is mounted.

A still further object of this invention is to provide a new and novel intrusion protection alarm device responsive to vibration which is of extremely low cost so as to minimize or substantially eliminate consumer resistance.

The object of this invention and other related objects are accomplished by the provision of a housing provided with means for attaching the housing to a supporting structure such as a door in a residence or the like. Electrically operated signaling means such as an audible alarm are provided in the housing together with an SCR having a gate for connecting the signaling means to an associated source of power such as a battery. Vibration responsive switch means such as a pendulum and ring assembly are connected to the SCR gate for activating the SCR when the housing is subjected to vibration such as opening of the door to connect the signaling means to the battery to thereby produce an audible alarm signal indicating an intrusion through the structure on which the alarm device is mounted.

Other objects and advantages of the invention will become apparent in the light of the following description when viewed in connection with the accompanying drawings in which;

DESCRIPTION OF THE PREFERRED EMBODIMENT

Figure 1:
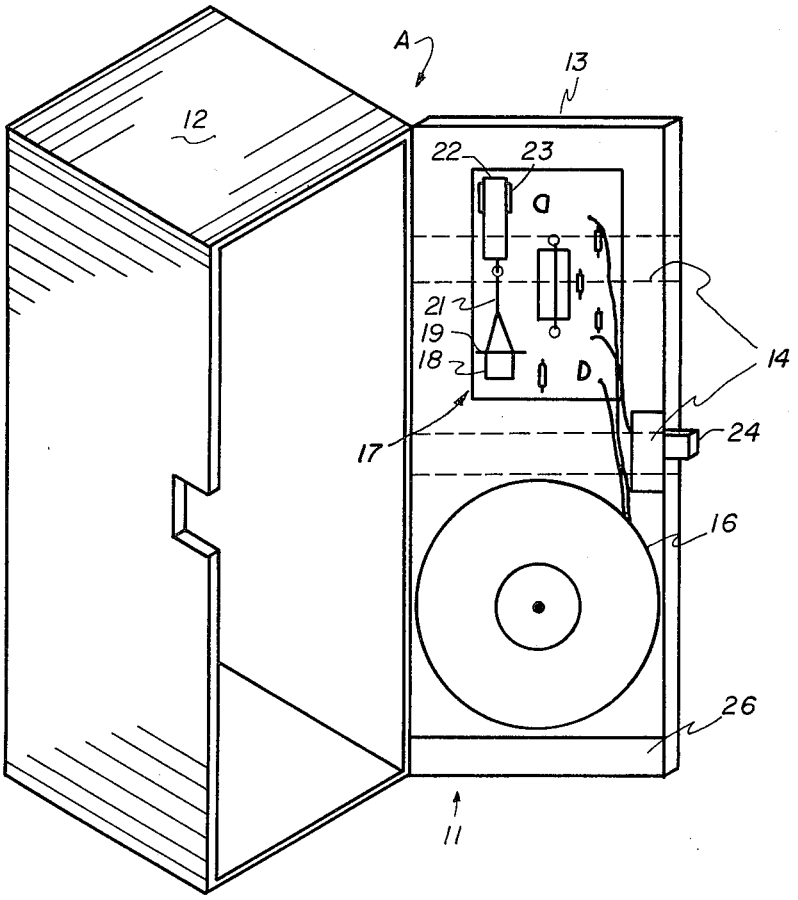
FIG. 1 is a perspective view of the alarm device of the invention with the housing cover removed.

Referring now to FIG. 1, there is shown an alarm device constructed in accordance with the invention and designated generally by the letter A. The alarm device A includes a housing 11 having a cover 12 and a base plate 13 arranged for interfitting detachable relationship. Means are provided for attaching the housing 11 to a supporting structure such as a door or the like which, in the illustrated embodiment, includes one or more double-face adhesive strips 14 attached to the rear side of the housing base plate 13.

As generally illustrative of the invention, the alarm device A includes an electrically operated signaling means such as a buzzer or horn 16 suitably mounted on the base plate 13 and a vibration responsive switch means 17. In the illustrated embodiment, the vibration responsive switch means 17 includes a pendulum 18 preferably of lead which may be silver plated and a ring 19 which may be brass coated with tin. Means are provided for supporting the pendulum 18 on the housing base plate 13 within the ring 19 for swinging movement from an inoperative position in spaced-apart relationship with the ring 19 in the absence of vibration on the housing 11 into an operative position in contact making engagement with the ring 19 in the presence of a vibration on the housing. In the illustrated embodiment, pendulum 18 which is preferably of pyramidal configuration is supported by means of a strand such as a wire 21 from a slide member or sleeve 22 retained for adjustable vertical movement within a retainer such as a spring clip 23 supported on the housing base plate 13.

The alarm device A also includes an on/off switch 24 and an associated source of power such as a battery 26.

Figure 2:
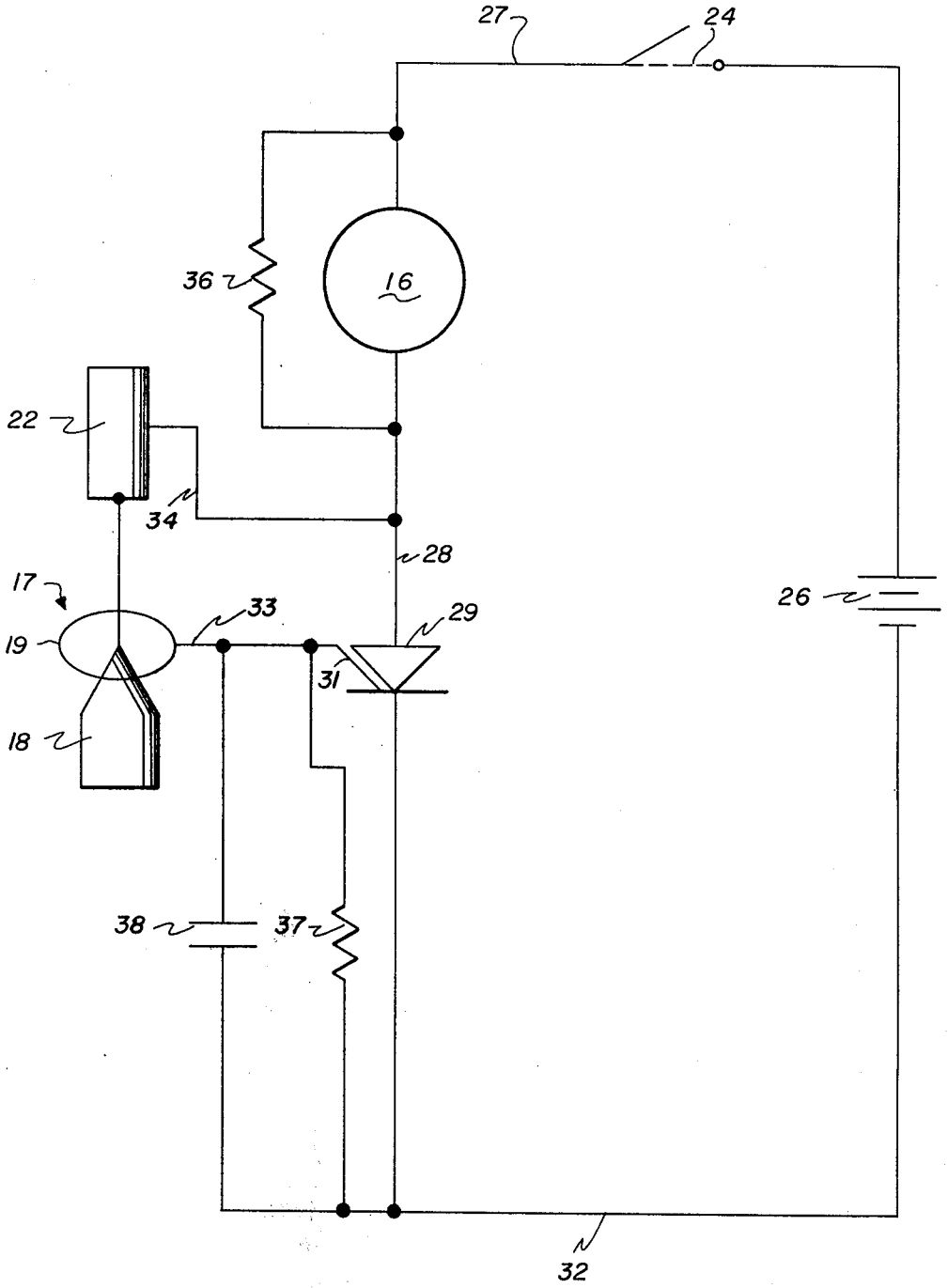
FIG. 2 is a schematic diagram of one embodiment of the invention.

Referring now to FIG. 2, there is shown one embodiment of the invention wherein the battery 26 has its positive terminal connected by means of conductor 27 through switch 24 to one side of the buzzer 16 the other side of which is connected by means of conductor 28 to the anode of an SCR 29 having a gate 31. The negative terminal of the battery 26 is connected by means of conductor 32 to the cathode of the SCR 29 and the gate 31 of the SCR 29 is connected by means of conductor 33 to the ring 19. In order to connect the gate 31 of the SCR 29 across the battery 26 through the pendulum and ring assembly 17, the metal sleeve 22 is connected by means of conductor 34 to the conductor 28 between the anode of SCR 29 and the other side of the buzzer 16. A resistor 36 is connected across the buzzer 16 for supplying a continuous level of holding current for the SCR when the buzzer contacts are open. A resistor 37 and capacitor 38 are connected in parallel between the conductor 33 and the negative conductor 32 of the battery 26.

In the operation of the embodiment of the invention shown in FIG. 2, the housing 11 is mounted in a vertically extending manner on a vertical wall surface such as a door or the like so that the pendulum 18 is disposed in the inoperative position out of contact with the ring 19. It can be understood that the vertical position of the sleeve 22 in the spring clip 23 is adjusted to vary the gap between the pendulum 18 and ring 19 thereby predetermining the magnitude of the vibration required to move the pendulum into contact making engagement with the ring 19. When the supported structure or door is moved slightly, the pendulum 18 is moved into the operative contact making position with the ring 19 to complete the circuit from the battery 26 through the SCR gate 31 triggering the SCR so that current flows from the battery 26 through the buzzer 16. Energization of the buzzer 16 by the SCR 29 therefore produces an alarm which is audible to notify an individual in the area of the alarm device A that intrusion is taking place. The switch 24 shown in the open solid line position of FIG. 2 at this time is in the dotted line closed position to permit energization of the buzzer 16 by the battery 26. To terminate the alarm signal produced by the buzzer 16, the switch 24 may be moved to the solid line position thereby disconnecting the battery 26 from the circuit.

Figure 3:
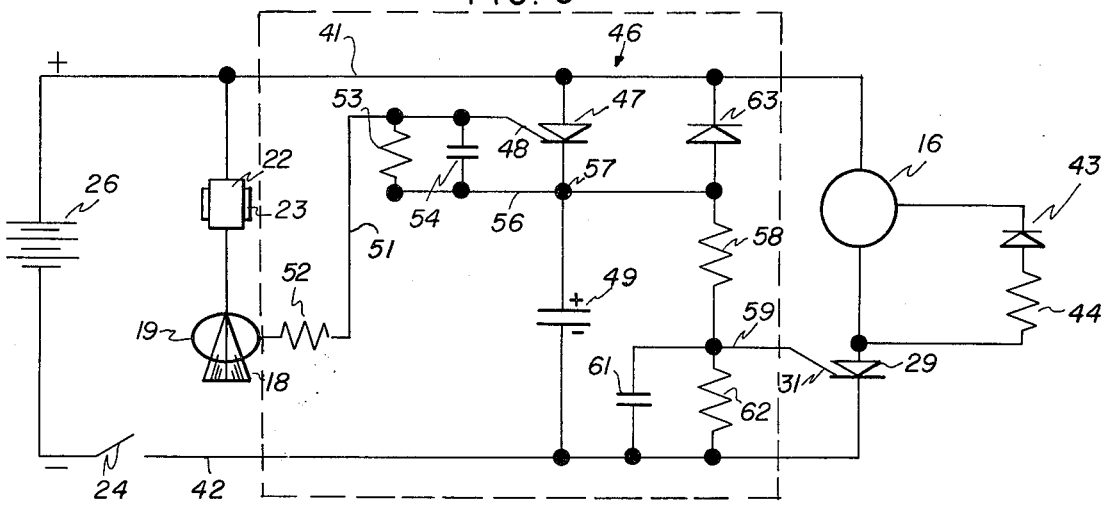
FIG. 3 is a schematic diagram of another embodiment of the invention.

Referring now to FIG. 3, there is shown another embodiment of the invention which includes timing means for automatically terminating the alarm signal after a predetermined period of time. It should be understood that like numerals are used to identify like parts in the embodiment of FIG. 3.

As shown in FIG. 3, the battery 26 has its positive and negative terminals connected by means of conductors 41, 42 and switch 24 to the buzzer 16 and SCR 29 respectively. The buzzer 16 and SCR 29 are connected in series as in the embodiment of FIG. 2. Preferably a diode 43 and resistor 44 are connected in series across the buzzer 16 for arc suppression.

In the embodiment of FIG. 3, means are provided for connecting the ring 19 to the gate 31 of SCR 29 as in the embodiment of FIG. 2. In FIG. 3, the connecting means includes timing means designated generally by the reference numeral 46 and shown between the broken lines of FIG. 3. The timing means 46, which permits the buzzer 16 to be activated for a predetermined period of time, includes an SCR 47 having a gate 48 connected between the positive conductor 41 and one side of a capacitor 49 the other side of which is connected to the negative conductor 42. The gate 48 of SCR 47 is connected by means of conductor 51 through a resistor 52 to the ring 19. A resistor 53 and capacitor 54, connected in parallel, are connected between the conductor 51 and a conductor 56 connected at a junction point 57 between the cathode of SCR 47 and one side of the capacitor 49.

Conductor 56 is connected through a resistor 58 to conductor 59 connected to the SCR gate 31. Conductor 59 is also connected through a parallel arrangement of a capacitor 61 and resistor 62 to the negative conductor 42. Conductor 56 is also connected through a diode 63 to the positive supply conductor 41.

In the operation of the embodiment of FIG. 3, a vibration imposed on the housing 11 in which the circuitry of FIG. 3 is diposed, moves the pendulum 18 into contact making engagement with the ring 19 to apply a triggering voltage to the gate 48 of SCR 47. Upon the application of this triggering voltage, SCR 47 conducts to charge capacitor 49 and when capacitor 49 is fully charged the current flowing through SCR 47 is less than the minimum holding current so that SCR 47 turns off. When SCR 47 turns off, capacitor 49 begins to discharge and current flows through resistor 58 to the gate 31 of SCR 29 to turn SCR 29 on and activate buzzer 16 to produce an audible alarm signal as in the embodiment of FIG. 2.

As the contacts of buzzer 16 make and break during operation, SCR 29 must be triggered continuously so that when capacitor 49 is discharged, the trigger current applied to gate 31 falls below the minimum triggering current and SCR 29 turns off so that buzzer 16 terminates the production of its audible signal. Thus, capacitor 49 forms a timing capacitor and is preferably of a capacity such that it will discharge and terminate the alarm signal within a predetermined period of time i.e. approximately 30 seconds to one minute. It should be understood that if contact is again made between the pendulum 18 and ring 19, the cycle is repeated and the buzzer 16 will continue to produce an audible signal.

Having thus described the invention, it should be apparent that numerous structural modifications and adaptations may be resorted to without departing from the spirit of the invention.

What is claimed is:

1. An alarm device comprising, in combination, a housing, means for attaching said housing to a supporting structure, an audible alarm in said housing, a battery in said housing, an SCR having a gate for connecting said audible alarm to said battery, vibration responsive switch means connected to said SCR gate for activating said SCR when said housing is subjected to vibration to connect said signaling means to said associated source of power for indication by said signaling means of the vibration on said housing, said vibration responsive switch means comprising a pendulum of tapered configuration and a ring assembly, means for supporting said pendulum in said housing within said ring for swinging movement from an inoperative position in spaced-apart relationship with said ring in the absence of vibration on said housing and an operative position in contact making engagement with said ring in the presence of vibration on said housing for activating said SCR, said pendulum supporting means including means for adjusting the axial position of said pendulum within said ring to thereby predetermine the magnitude of the vibration for moving said pendulum into said operative position, said adjusting means including a retainer on said housing, a slide member mounted on said retainer for movement into a selected vertical position, a strand of predetermined length connected between said slide member and said pendulum to provide a constant frequency of sensitivity, said slide member being movable into said selected vertical position for adjusting the sensitivity of said vibration responsive switch means at said constant frequency of sensitively, said SCR being connected in series with said audible alarm, the positive terminal of said battery being connected to one side of said audible alarm and the negative terminal of said battery being connected to the cathode of said SCR, means for connecting said ring to the gate of said SCR and means for connecting said pendulum to one side of said audible alarm.

2. An alarm device in accordance with claim 1 wherein said means for connecting said ring to said SCR gate includes timing means connected to said SCR for deactivating said SCR after a predetermined period of time.

3. An alarm device in accordance with claim 2 wherein said timing means comprises a capacitor having one side connected to the negative terminal of said battery, a further SCR having a gate for connecting said capacitor to said battery to fully charge said capacitor upon movement of said pendulum into said operative position, said further SCR having a cathode connected to the other side of said capacitor and an anode connected to said positive terminal of said battery, and means for connecting said capacitor other side to the gate of said SCR connected to said audible alarm to activate said SCR for a predetermined period of time corresponding to the period of discharge of said fully charged capacitor.

* * * * *